US005460375A

United States Patent [19]

Hardee

[11] Patent Number: 5,460,375

[45] Date of Patent: Oct. 24, 1995

[54] GOLF BALL PUTTER

[75] Inventor: Artis B. Hardee, P.O. Box 752, Kitty Hawk, N.C. 27949

[73] Assignees: Artis B. Hardee; Margaret C. Hardee, Southern Shores, N.C.

[21] Appl. No.: 295,513

[22] Filed: Aug. 24, 1994

[51] Int. Cl.[6] ..... A63B 53/00

[52] U.S. Cl. ..... 273/164.1; 273/80 R; 273/175; 273/167 J; 273/167 R

[58] Field of Search ..... 273/167 R, 81 R, 273/175, 171, 67 F, 67 D B, 81.5, 169

[56] References Cited

U.S. PATENT DOCUMENTS

| | | | |
|---|---|---|---|
| 3,252,706 | 5/1966 | Rosasco, Sr. | 273/81.5 |
| 3,700,244 | 10/1972 | Liotta | 273/183 D |
| 3,881,733 | 5/1975 | Csernits | 273/168 |
| 3,898,257 | 11/1976 | Barr | 273/175 |
| 4,121,833 | 10/1978 | Prueter | 273/175 |
| 4,819,939 | 4/1989 | Kobayashi | 273/81 R |
| 4,846,477 | 7/1989 | Phelan | 273/175 |
| 4,881,737 | 11/1989 | Mullins | 273/80 A |
| 5,213,332 | 5/1993 | Fahy et al. | 273/187.4 |
| 5,322,285 | 6/1994 | Turner | 273/175 |

*Primary Examiner*—V. Millin
*Assistant Examiner*—Charles W. Anderson
*Attorney, Agent, or Firm*—Irving M. Freedman

[57] ABSTRACT

A golf ball putter including a concaved surface and a deformable handle which temporarily conforms to the fingers of the golfer during use. The reverse face of the putter may include a central cavity and a pair of tapered cavities to reduce weight and improve balance. A concaved ball striking face includes a central flatted portion with a pair of slightly curved surfaces extending from the flatted portion.

8 Claims, 2 Drawing Sheets

GOLF BALL PUTTER

BACKGROUND OF THE INVENTION

This invention relates to a golf ball putter, and in particular to an improved golf ball putter which facilitates imparting the proper direction of the drive of the golf ball.

Most golfers experience problems in their putts from time to time. The problems are attributable to a multiplicity of causes, some of which are random, including inadvertent twisting of the golf club shaft during the stroke, imprecisely contacting the golf ball by the putter face, and/or lack of control in imparting a force to the golf ball along the desired line of travel. It has been determined that factors such as balance and weight of the golf club also contributes to the inability to provide an accurate and smooth putting stroke.

There have been many attempts to provide improved putters, many with particular merit, but defects are also present in not fully resisting inadvertent twisting of the shaft while at the same time facilitating the proper directional aspects of the putt and providing improved balance and weight.

OBJECTS AND SUMMARY OF INVENTION

It is an object of the present invention to provide a golf ball putter which improves the accuracy of putting in imparting a proper direction of drive to the golf ball.

It is another object of the present invention to provide an improved golf ball putter which resists and prevents inadvertent twisting of the shaft which would otherwise adversely affect the proper direction of drive imparted to the golf ball.

It is still another object of the present invention to provide an improved golf ball putter with a shaped putting surface which facilitates obtaining the proper directional aspects of the putt.

It is a further object of the present invention to provide a improved golf ball putter with an improved grip conforming to the golfer and with improved balance and weight on the golf ball hit to improved control of the putt by the golfer.

In accordance with one form of the present invention, a golf ball putter includes a shaft with a gripping portion at one end adapted for gripping by the golfer, and a ball striking head secured to the other end of the shaft. The gripping portion includes a deformable material which temporarily conforms to the contours to the hands gripping a golf ball putter to assist in preventing inadvertent twisting of the shaft. The ball striking head includes a shaped concave surface substantially parallel to the axis of the shaft. The golf ball striking surface includes a substantially flat surface adjacent to the axis with the shaft with a pair of slightly curved portions extending outward from the ends of the planar portion forming a substantially concave surface. The concave surface assists in imparting the proper directional drive to the ball. The curvature of radius of the curved portions is approximately 28 inches, providing a slight, yet significant curvature.

The reverse portion of the putter opposite of the ball striking surface may also include a slight curvature cavities to improve the weight and balance of the putter. A central spherical cavity adjacent the axis of the shaft is centered between a pair of tapering cavities with a decreasing cross section and depth in a direction away from the shaft.

BRIEF DESCRIPTION OF INVENTION

Figure 1:
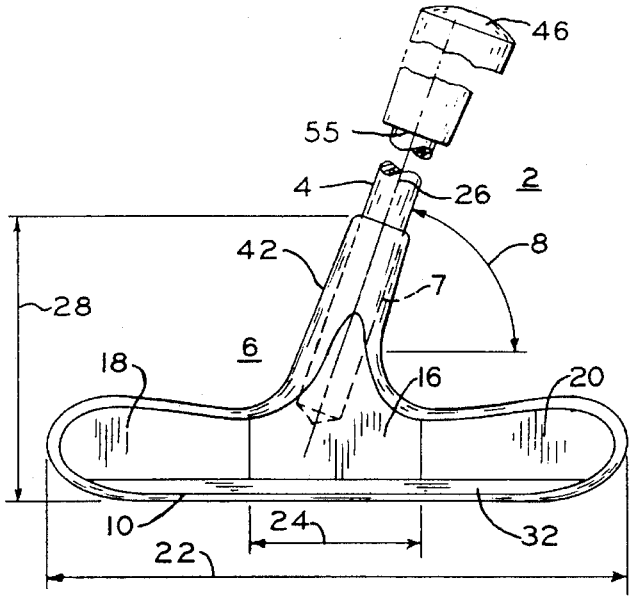
FIG. 1 is a side elevational view of a golf putter in accordance with the present invention.
Figure 2:
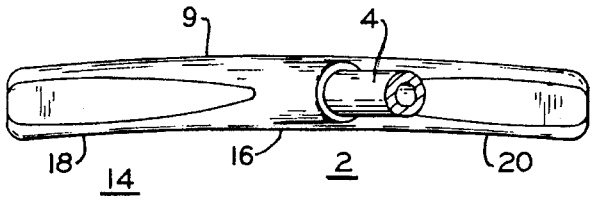
FIG. 2 is an end view of the golf putter of FIG. 1.
Figure 3:
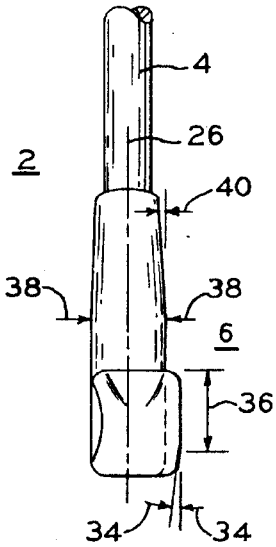
FIG. 3 is a side view of the golf putter of FIG. 1.

Referring first to FIGS. 1–3, golf putter 2 includes a shaft 4 secured to putter head 6 within shaft engaging hole 7 drilled at an angle 8 relative to bottom surface 10 of the putter head. Angle 8 is 71.60 and head 6 is brass, although bronze or steel may be used. Golf ball striking surface 14 includes a central substantially planar surface 16 with a pair of slightly concave end portions 18 and 20 extending away from central planar surface 16. The radius of curvature of end portions 18 and 20 is in the range of 25–30 inches with 28.683 inches providing desired results. Shaft 4 is 34 inches long.

Overall length 22 of head 6 is 4.985 inches while length 24 of central surface 16 is 1.300 inches. Height 28 of head 6 is 2.393 inches, and the depth of shaft engaging bore 7 is 1.80 inches with the bore having a diameter of 0.402 inches about axis 26 which is also the axis of shaft 4. Sloped portion 32 adjacent bottom surface 10 slopes from central surface 16 and end portions 18 and 20 7.0° from the vertical as best shown by arrows 34 in FIG. 3. Height 36 of concave ball striking surface 14 is 0.667 inches, the width of head 6 at the thickest point indicated by arrows 38 is 0.625 inches, and the tapering angle indicated by arrows 40 of shaft engaging portion 42 of head 6 is 3.0 deg.

Figure 4:
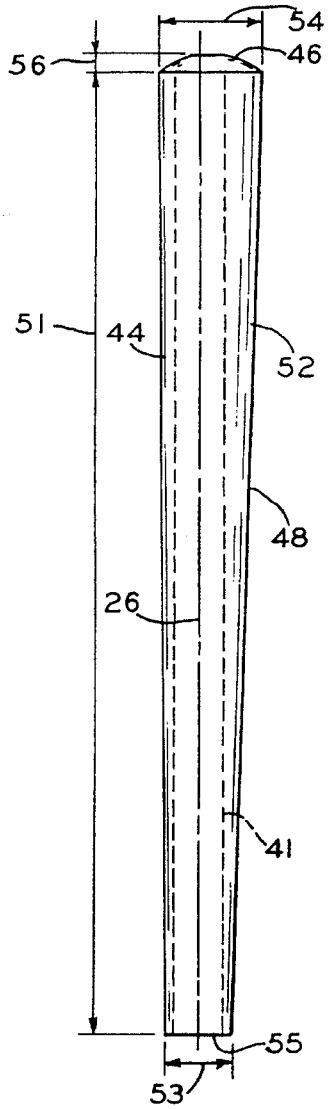
FIG. 4 is an end view of the shaft of the golf putter of FIG. 1 including a gripping surface.
Figure 5:
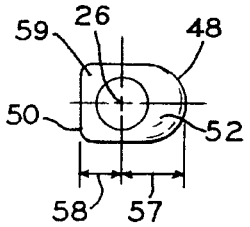
FIG. 5 is a right side view of FIG. 4.

The positive or "True-grip" tapered putter handle is best shown in FIGS. 4–5. Referring to FIGS. 4–5, handle 44 includes a cylindrical bore 41 having a diameter of 0.580 inches. Tapered putter handle 44 surrounds shaft 4 (as best shown FIG. 1) with an endcap 46 overlying the shaft and handle on the end remote from putter head 6. Putter handle 44 includes tapered rounded portion 48 which increases in thickness as it extends from putter 6 end 55, and a flatted surface 50 opposite the tapered rounded portion as best shown in FIG. 5, forming a thickened finger gripping portion 52 adapted to receive the fingers of the golfer. Overall length 51 of handle 44 is 10.750 inches, and axial thickness 56 of cap 44 is 0.214 inches. The taper of handle 44 increases from 0.78 inches as indicated by arrow 53 of the end 55 adjacent putter head 6 to 1.205 inches as indicated by arrow 54 at the end of handle 44 remote from the putter head. As shown in FIG. 5, the distance 57 from axis 26 to the thickest part of rounded portion 48 of putter handle 44 is 0.726 inches, while the distance 58 from the axis to flatted surface 50 is 0.480 inches. The radius of rounded portion 48 about axis 26 is 0.443 inches, while the radii of rounded corners 59 is 0.100 inches.

Tapered putter handle 44 is ethelene-prophlene-diene mixed with synthetick rubber and sponge, heated to 350 degrees F and injection molded providing a soft rubber-like compound including air bubbles, and exhibiting a sponge-like deformable character that assumes the configuration of the grip of the golfer's hands. In operation and use the molded, positive custom grip thus formed resists and prevents inadvertent twist of shaft 4 which would otherwise adversely affect the directional aspects of the putt. The slightly concave ball striking surface 14 provides a substantial "softspot" in central planar surface 16, while curved end portions 18 and 20 assist in correcting and eliminating errors due to misalignments of the putter face to the correct line of the putt to drive the golf ball to minimize and eliminate directional abnormalities which would otherwise result.

Figure 6:
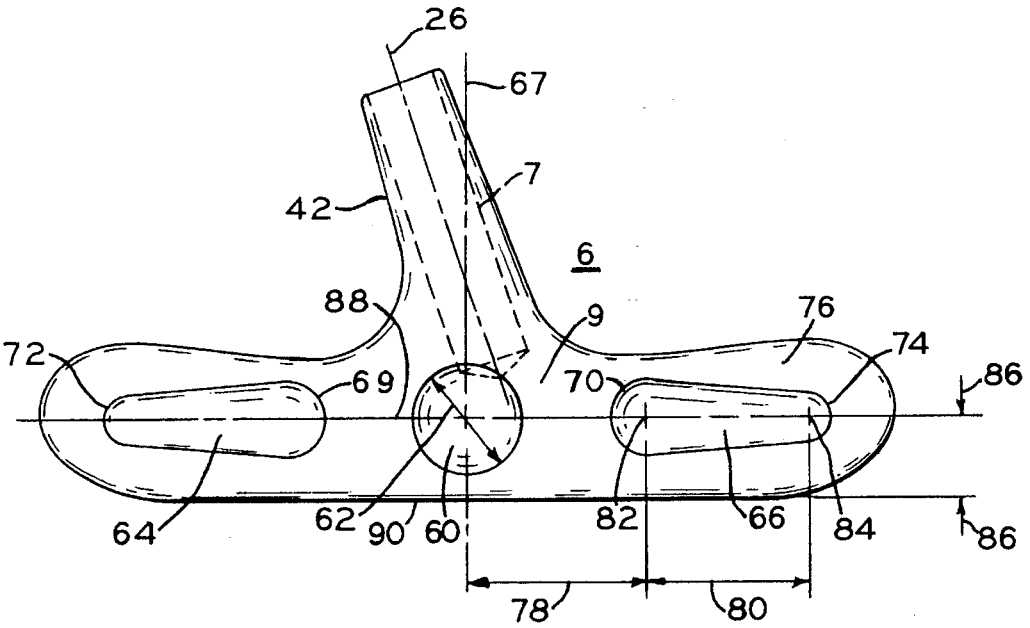
FIG. 6 is an elevational view of the rear surface of a golf putter such as that shown in FIG. 1.

It has been found that optimizing weight and balance of a golf club assists in providing a proper feel and resulting swing to further enhance the accuracy of the golf putt. Weight and balance of golf putter 2 can be improved by removing portions of the rear surface of putter head 6 as best shown in FIG. 6. Referring to FIG. 6, putter head 6 includes a central rounded cavity 60 formed through use of a 1.0 inch diameter ball end end-mill to cut center cavity 60 to a depth of 0.112 inches producing a surface diameter of 0.630 inches shown by arrow 62. In addition to center cavity 60, fluted cavities 64 and 66 are provided to further reduce weight and enhance balance. Cavities 64 and 66 taper from their large ends 69 and 70, respectively, adjacent, but separated from, center cavity 60 and symmetrical about vertical axis 67. Putter head 6, with the exception of shaft-engaging portion 42, is symmetrical about vertical axis 67. Fluted cavities 64 and 66 taper from wide ends 69 and 70, respectively, toward narrow ends 72 and 74 respectively. The depth of fluted cavities 64 and 66 slopes 5 degrees from a depth of 0.074 inches at wide ends 69 and 70 to small ends 72 and 74, respectively, where they strike the surface 76 of putter head 6. The distance 78 between vertical axis 67 and the center of central cavity 60 is 1.042 inches, while the distance 80 between the centers of curvature 82 and 84 of rounded large end 70 and rounded small end 74 is 0.950 inches. Fluted cavities 64 and 66 may be machined using a ⅝th inch diameter ball end end-mill. The a distance indicated by arrows 86 between the longitudinal axis 88 extending perpendicular to vertical axis 67 and passing through the centers of central cavity 60 and fluted cavities 64 and 66 to the bottom surface 90 of putter head 6 is 0.450 inches.

Figure 7:
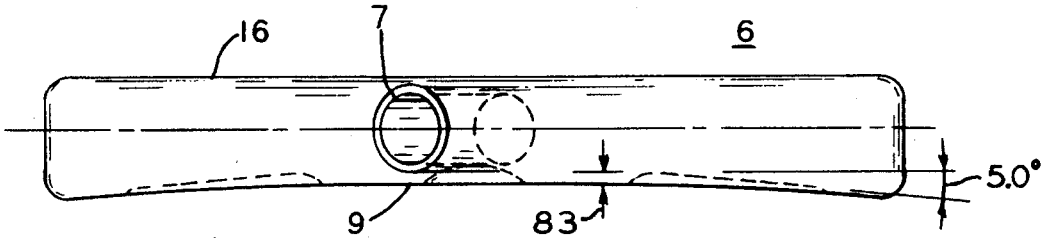
FIG. 7 is a top view of FIG. 6.

It has been found that providing central cavity 60 and fluted cavities 64 and 66 as shown in FIG. 6 results in a better balanced and better controlled putter, facilitating and enhancing the accuracy of the use of the putter. The cavities 60, 64, and 66 are provided in rear surface 9 of putter 6. In accordance with present American Golf Association rules the use of a concave ball striking surface for putter 6 is not authorized for tournament use. It is suitable for and may be used in non-tournament use. As a result, the use of cavities 60, 64 and 66 on rear surface 9 on golf putter 6 along with the use of a concave surface such as ball striking surface 16 of FIG. 2 may be utilized in combination with the shaft and handle of FIG. 4 to provide an improved putter for non-American Golf Association sanctioned tournaments. For use in sanctioned tournaments the ball striking surface 16 would not be concave but rather would be flat as shown in FIG. 7. However, for non-tournament play the improved performance obtained by utilizing a curved ball striking surface as shown in FIGS. 1 and 2 is preferable and desirable and may be used in combination with cavities 60, 64 and 66 on the rear surface as shown in FIG. 6.

While the present invention has been described with respect to certain preferred embodiments thereof, it is to be understood that numerous variations in the details of construction, the arrangement and combination of parts, and types of materials used may be made without departing from the spirit and scope of the invention.

What I claim is:

1. A gold ball putter comprising:

A shaft with an axis and a gripping portion at one end thereof adapted for gripping by a golfer;

a ball striking head secured to the end of said shaft remote from said gripping portion;

said gripping portion including a deformable material which will at least temporarily conform to the contours of the golfer's hands gripping said deformable material;

said ball striking head including a shaped substantially concave surface;

whereby said golf ball putter resists any minute movements of the golfer's wrist and assists in the alignment of said putter to the correct line of the putt;

wherein the concave surface is the golf ball striking face; and wherein the reverse surface opposite said golf ball striking face includes a substantially flat central portion with a concave indentation defining a substantially spherical cavity.

2. The golf ball putter of claim 1 wherein said reverse surface includes a pair of curved end portions extending from said central position and said curved end portions each include a tapered cavity extending in a direction along the length of said reverse surface.

3. The golf ball putter of claim 2 wherein each said tapered cavity tapers in a decreasing cross section in a direction away from said spherical cavity.

4. The golf ball putter of claim 1 wherein said shaft includes a rigid central portion surrounded by said deformable material gripping portion and said deformable material reverts to a substantially smooth non-deformed surface configuration after release of pressure thereon.

5. The golf ball putter of claim 1 wherein said gripping portion extends further from the axis of said shaft at the end remote from said ball striking head forming a thickened grip region which is flatted in a direction perpendicular to said axis and rounded on the opposite side of said shaft to form a finger gripping portion.

6. The golf ball putter of claim 5 wherein said deformable material is a spongy rubbery compound.

7. The golf ball putter of claim 5 wherein said deformable material is ethelene-prophlene-diene mixed with synthetic rubber and sponge.

8. The golf ball putter of claim 5 wherein said finger gripping portion extends further from said shaft than said flatted position in the direction perpendicular to said axis.

* * * * *